US006718677B2

(12) United States Patent
Camp

(10) Patent No.: US 6,718,677 B2
(45) Date of Patent: Apr. 13, 2004

(54) PLUG FOR A FIREARM

(76) Inventor: Thomas Camp, P.O. Box 593, Alma, MI (US) 48801-0593

( * ) Notice: Subject to any disclaimer, the term of this patent is extended or adjusted under 35 U.S.C. 154(b) by 0 days.

(21) Appl. No.: 10/091,045

(22) Filed: Mar. 4, 2002

(65) Prior Publication Data

US 2002/0129531 A1 Sep. 19, 2002

Related U.S. Application Data

(60) Provisional application No. 60/273,368, filed on Mar. 5, 2001.

(51) Int. Cl.[7] ..... F41C 9/08

(52) U.S. Cl. ..... 42/51; 42/77; 42/108; 29/256

(58) Field of Search ..... 42/51, 77, 83, 42/108; 29/256

(56) References Cited

U.S. PATENT DOCUMENTS

| | | | | | |
|---|---|---|---|---|---|
| 158,221 | A | | 12/1874 | Smith | |
| 3,156,373 | A | * | 11/1964 | Willis | 220/237 |
| 3,196,569 | A | | 7/1965 | Thomason | 42/77 |
| 3,757,447 | A | * | 9/1973 | Rowe | 42/51 |
| 3,805,434 | A | | 4/1974 | Sudano et al. | 42/77 |
| 3,824,672 | A | * | 7/1974 | Michelsen | 29/263 |
| 4,186,506 | A | | 2/1980 | Pawlak et al. | 42/83 |
| 4,222,191 | A | | 9/1980 | Lee et al. | 42/77 |
| 4,232,468 | A | | 11/1980 | Chapin | 42/77 |
| 4,266,468 | A | * | 5/1981 | Biggs | 92/128 |
| 4,437,249 | A | | 3/1984 | Brown et al. | 42/51 |
| 4,519,157 | A | | 5/1985 | Giangerelli | 42/83 |
| 4,702,170 | A | | 10/1987 | Trudeau | 102/446 |
| 4,823,651 | A | * | 4/1989 | England | 81/124.4 |
| 4,912,868 | A | | 4/1990 | Thompson | 42/77 |
| 5,010,677 | A | | 4/1991 | Carron | 42/77 |
| 5,133,143 | A | | 7/1992 | Knight | 42/51 |
| 5,157,210 | A | | 10/1992 | Davis | 42/77 |
| 5,179,234 | A | * | 1/1993 | Cvetanovich | 42/70.11 |
| 5,351,428 | A | * | 10/1994 | Graham | 42/106 |
| 5,623,779 | A | * | 4/1997 | Rainey, III | 42/51 |
| 5,706,598 | A | | 1/1998 | Johnston | 42/51 |
| 5,755,053 | A | | 5/1998 | Oakley | 42/51 |

* cited by examiner

*Primary Examiner*—Michael J. Carone
*Assistant Examiner*—James S. Bergin
(74) *Attorney, Agent, or Firm*—Howard & Howard

(57) ABSTRACT

A plug assembly for inserting in a breech of a breech-loaded firearm to convert the breech-loaded firearm to a muzzle-loaded firearm is provided. The plug body is slidable in the breech and includes first and second ends. The plug body defines a powder chamber adjacent the first end, an ignition counterbore in firing communication with the powder chamber, and an access counterbore adjacent the second end of the plug. The plug body includes a mechanical interlocking device in the access counterbore to facilitate removal of the plug body from the breech of the breech-loaded firearm.

18 Claims, 3 Drawing Sheets

PLUG FOR A FIREARM

The present application relates to and claims the benefit of provisional application Ser. No. 60/273,368 filed Mar. 5, 2001.

TECHNICAL FIELD

The present invention relates to a plug assembly for use in a breech-loaded firearm to convert the breech-loaded firearm to a muzzle-loaded firearm.

BACKGROUND OF THE INVENTION

Muzzle-loaded firearms have increased in popularity over the past few years as a result of additional hunting seasons dedicated to muzzle-loaded firearms. Consequently, several gun manufacturers now carry their own line of muzzle-loaded firearms, however, muzzle-loaded firearms are expensive and difficult to maintain.

As a result of the high capital expenditure required to add a muzzle-loaded firearm to one's firearm collection, there is a need to develop a product that eliminates the need to purchase a separate muzzle-loaded firearm to utilize during muzzle-loaded firearm seasons. U.S. Pat. No. 4,232,468 to Chapin, U.S. Pat. No. 4,437,249 to Brown et al., U.S. Pat. No. 5,010,677 to Verney Carron, and U.S. Pat. No. 5,755,053 to Oakley, all suggest placing a cylindrical plug in a barrel of a breech-loaded firearm to convert the breech-loaded firearm to a muzzle-loaded firearm. In this manner, a hunter that already has a breech-loaded firearm, such as a shotgun, can convert the shotgun to a muzzle-loaded firearm without having to purchase a separate and distinct muzzle-loaded firearm. The cylindrical plug is placed in the breech of the shotgun thereby converting the shotgun to a muzzle-loaded firearm.

The '468 patent to Chapin discloses a cylindrical plug defining a primer-receiving chamber at one end of the cylindrical plug, a powder charge chamber at the other end of the cylindrical plug and a third bore between the two chambers. The cylindrical plug is slidably fit into a breech of a firearm and includes a flange at one end to limit movement in the breech. A percussion type primer cap is placed in the primer-receiving chamber and black powder is placed in the powder charge chamber. A firing mechanism of the breech loaded firearm strikes the percussion type primer cap creating a flash that ignites the black powder through the third bore. Ignition of the black powder creates an explosion that propels a projectile disposed adjacent to the powder charge chamber of the cylindrical plug. Unfortunately, there is no mechanism associated with the cylindrical plug to remove the cylindrical plug from the breech. Hence, when the plug needs to be removed and cleaned or the breech needs to be cleaned, there is no formal manner in which the cylindrical plug can be removed.

Many muzzle-loaded firearms include removable plug assemblies to facilitate cleaning of the muzzle-loaded firearm. A typical muzzle-loaded firearm plug assembly, as shown in U.S. Pat. No. 5,133,143 to Knight, includes a powder chamber and an ignition chamber as discussed in the aforementioned prior art. The plug assembly of U.S. Patent '143 to Knight, however, includes threads on its outer surface to threadably engage a barrel of the muzzle-loaded firearm. The plug assembly can be threaded and unthreaded from the barrel using a screwdriver like tool that engages a groove defined in the plug assembly. However, the plug assembly of the '143 patent to Knight cannot be used to convert a breech-loaded firearm to a muzzle-loaded firearm.

The plug assembly of the '143 patent includes threads on the outer surface to engage a threaded barrel of the muzzle-loaded firearm. However, breech-loaded firearms do not include threads in the barrel to receive the plug assembly of the '143 patent. As a result, if the plug assembly of the '143 patent were used to convert the breech-loaded firearm to the muzzle-loaded firearm, many problems would occur. Specifically, there would not be an adequate seal between the plug assembly and the barrel resulting in severe blow-back during ignition that may harm a user. Furthermore, the plug assembly of the '143 patent does not include a flange to limit movement of the plug assembly in the breech of the breech-loaded firearm. Hence, the plug assembly of the '143 patent would likely slide out of an end of a barrel of the breech-loaded firearm.

The prior art patents do not disclose a plug assembly for converting a breech-loaded firearm to a muzzle-loaded firearm that includes a feature for facilitating removal of the plug assembly from the breech-loaded firearm after use. Therefore, a long-felt need exists to devise a feature of the plug assembly that would allow an operator to easily remove the plug from the breech-loaded firearm.

SUMMARY OF INVENTION

The present invention provides a plug assembly for inserting in a breech of a breech-loaded firearm to convert the breech-loaded firearm to a muzzle-loaded firearm. The plug assembly includes a plug body slidable in the breech having a first end and a second end. The plug body defines a powder chamber adjacent the first end, an ignition counterbore in firing communication with the powder chamber, and an access counterbore adjacent the second end of the plug. In addition, the plug body includes a mechanical interlocking device in the access counterbore to facilitate removal of the plug body from the breech of the breech-loaded firearm.

The present invention provides several advantages over the prior art including the use of the mechanical interlocking device in the access counterbore to facilitate removal of the plug body from the breech of the breech-loaded firearm. Easy removal of the plug body is critical to a hunter that has limited time when hunting. The mechanical interlocking device allows the hunter to easily remove the plug body from the breech of the breech-loaded firearm to clean the breech, change percussion nipples, quickly disarm the breech-loaded firearm, and so on.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE PREFERRED EMBODIMENT

Referring to the Figures, wherein like numerals indicate like or corresponding parts throughout the several views, a plug assembly to insert in a breech 10 of a breech-loaded firearm 12 to convert the breech-loaded firearm 12 to a muzzle-loaded firearm 14 is generally shown at 16. It is to be understood that when the plug assembly 16 is slid into the breech 10 of the breech-loaded firearm 12, the breech-loaded firearm 12 becomes the muzzle-loaded firearm 14. In general, for ease of description, reference will only be made to the breech-loaded firearm 12.

Figure 1:
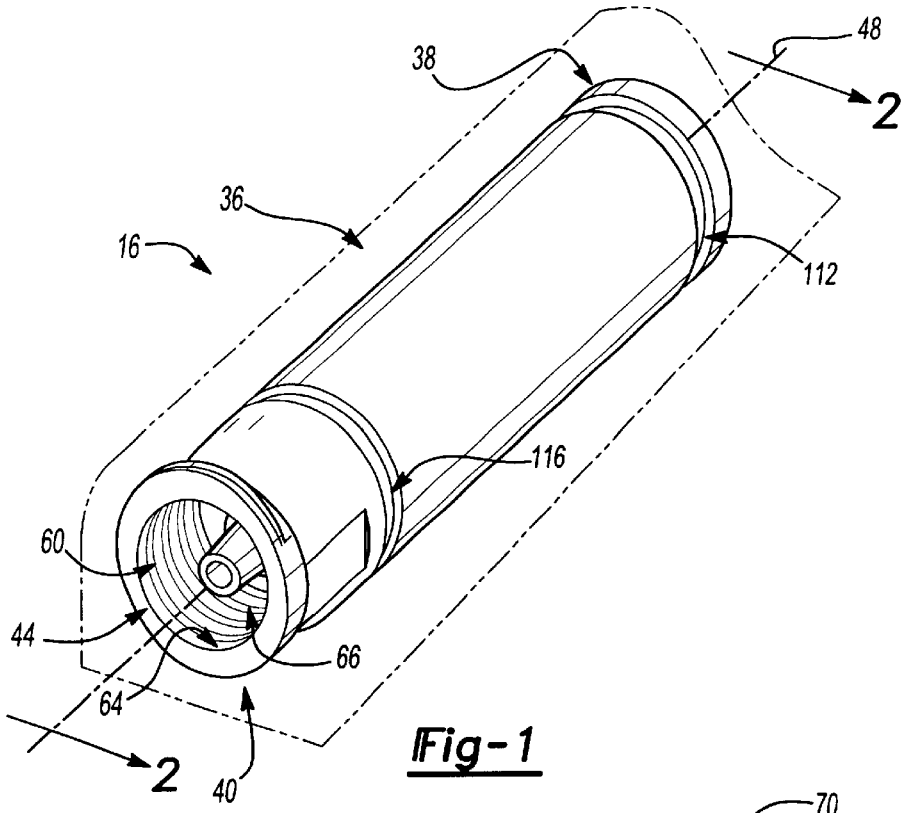
FIG. 1 is a perspective view of a plug assembly of the present invention.

It is to be appreciated by those skilled in the art that breech-loaded firearms generally includes shotguns and the like. A gauge or size of the breech-loaded firearm 12 is not intended to limit the present invention. The breech-loaded firearm 12 is well known in the art and will only be described for illustrative purposes. Referring to FIG. 1, the breech-loaded firearm 12 generally includes a barrel 18 having a breech end 20 further defining the breech 10 and a sight end. The barrel 18 includes a smooth inner surface 24 throughout the length of the barrel 18 to facilitate the propulsion of projectiles 26 out of the sight end of the barrel 18. The breech-loaded firearm 12 further includes a stock 28 housing a triggering mechanism 30 and a firing pin 32 biased by a spring 34. The stock 28 and the barrel 18 are movable relative to one another to load the plug assembly 16 in the breech 10 and to lock in the plug assembly 16 in the breech 10.

The plug assembly 16 comprises a plug body 36 axially slidable in the breech 10 of the breech-loaded firearm 12 by a user. In the preferred embodiment, the plug body 36 is generally cylindrical in shape and made from steel. However, the plug body 36 can be made from any number of materials including aluminum, tungsten, beryllium, and the like. The plug body 36 has a first end 38 and a second end 40 with the first end 38 being slidably fit into the breech 10 of the breech-loaded firearm 12, as shown in FIG. 2.

Figure 2:
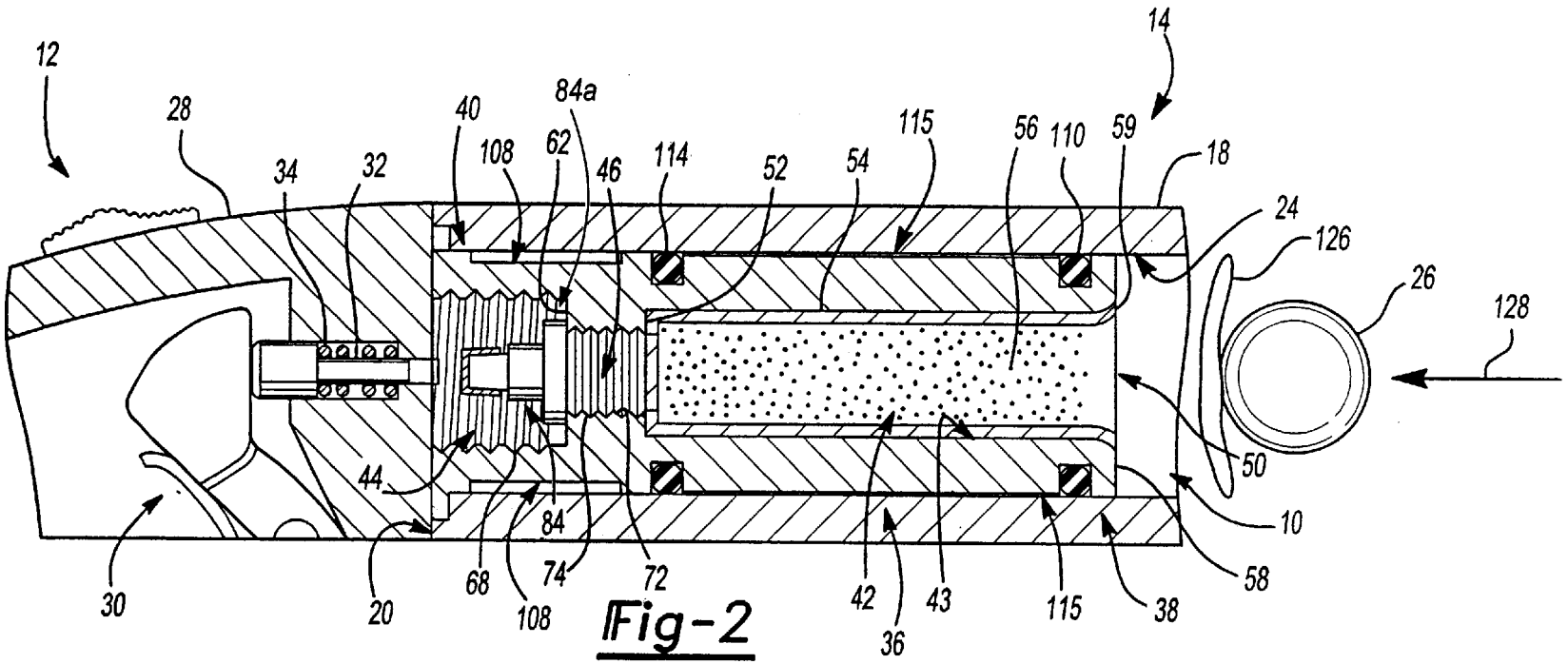
FIG. 2 is a cross sectional view of an alternative embodiment of the present invention generally taken along line 2—2 of FIG. 1.

Referring to FIG. 2, the plug body 36 defines a powder chamber 42 adjacent to the first end 38, an access counterbore 44 adjacent to the second end 40 of the plug body 36, and an ignition counterbore 46 in firing communication with the powder chamber 42 and in operative communication with the access counterbore 44. In the preferred embodiment, the access counterbore 44, ignition counterbore 46, and powder chamber 42 are all concentrically disposed one after another about a central axis 48 of the plug body 36 such that ignition counterbore 46 provides operative communication between the access counterbore 44 and the powder chamber 42. The concentric relationship between the powder chamber 42, access counterbore 44, and ignition counterbore 46 is important for focusing ignition forces and firing forces centrally along the central axis 48. This central focus reduces transverse stresses on the breech-loaded firearm 12 and the plug body 36 and more effectively propels the projectile 26 out of the sight end of the barrel 18.

The powder chamber 42, access counterbore 44, and ignition counterbore 46 have first, second, and third diameters as measured perpendicular to the central axis 48. In the preferred embodiment, both the first diameter of the powder chamber 42 and the second diameter of the access counterbore 44 are greater than the third diameter of the ignition counterbore 46 and the first and second diameters are the same size. It should be appreciated that the access counterbore 44, ignition counterbore 46, and powder chamber 42 are not limited to their concentric orientation about the central axis 48 or to their relative diameters. For example, each could have the same diameter and be offset by the other such that the concentric relationship is extinguished.

The powder chamber 42 is cylindrically shaped and extends longitudinally from a first opening 50 at the first end 38 to a first ledge 52 adjacent to the ignition counterbore 46 in the plug body 36. The first ledge 52 defines a transition in size between the powder chamber 42 and the ignition counterbore 46. The powder chamber 42 is further defined by an inner surface 43 of the plug body 36 also having a cylindrical shape and extending longitudinally in the plug body 36. The inner surface 43 may include a protective layer 54 to protect the plug body 36. The powder chamber 42 receives a powder charge 56 to be ignited to propel the projectile 26 out of the sight end of the barrel 18. The powder charge 56 is made from black powder and the like, as is well known in muzzle-loaded firearm hunting. The powder charge 56 will hereinafter be referred to as black powder 56. The first end 38 of the plug body 36 includes a rim 58 that is annular about the first opening 50 of the plug body 36. The rim 58 is beveled on an inner edge 59 to facilitate placement of the projectile 26 adjacent the powder chamber 42.

The access counterbore 44 is cylindrical in shape and extends from a second opening 60 at the second end 40 of the plug body 36 to a second ledge 62 adjacent to the ignition counterbore 46. The second ledge 62 defines a transition in size between the access counterbore 44 and the ignition counterbore 46. The access counterbore 44 is further defined by a first inner surface 64 of the plug body 36. The plug body 36 includes a mechanical interlocking device 66 in the access counterbore 44 to facilitate removal of the plug body 36 from the breech 10 of the breech-loaded firearm 12. The mechanical interlocking device 66 is further defined as the first inner surface 64 having threads 68 to facilitate removal of the plug body 36 from the breech 10 of the breech-loaded firearm 12. The threads 68 are circumferentially disposed about the central axis 48 on the first inner surface 64 of the plug body 36. The threads 68 of the first inner surface 64 extend from the second opening 60 at the second end 40 to the second ledge 62. The use of a tool 70 to engage the threads 68 of the first inner surface 64 to remove the plug body 36 will be described further below.

The mechanical interlocking device 66 is not limited to the threads 68 on the first inner surface 64 of the plug body 36. Any mechanism that can be used for engagement by a tool to remove the plug assembly 16 can be used. Such mechanisms may include a catch on the plug body for use with a hook-shaped tool, a finger on the plug body for grasping with pliers, a loop on the plug body for being hooked, a bayonet connector on the plug body, a snap-in lock on the plug body for use with a locking tool, a lip on the plug body for use with a tool having fingers that expand outward to catch the lip of the plug body, holes in the plug body for being engaged by a tool, and the like.

The ignition counterbore 46 extends between the first ledge 52 and the second ledge 62. The ignition counterbore 46 is further defined by a second inner surface 72 of the plug body 36 having threads 74. The threads 74 of the second inner surface 72 are circumferentially disposed about the central axis 48 and extend from the first ledge 52 to the second ledge 62. The threads 74 of the second inner surface 72 have a smaller diameter than the threads 68 of the first inner surface 64.

Figure 3:
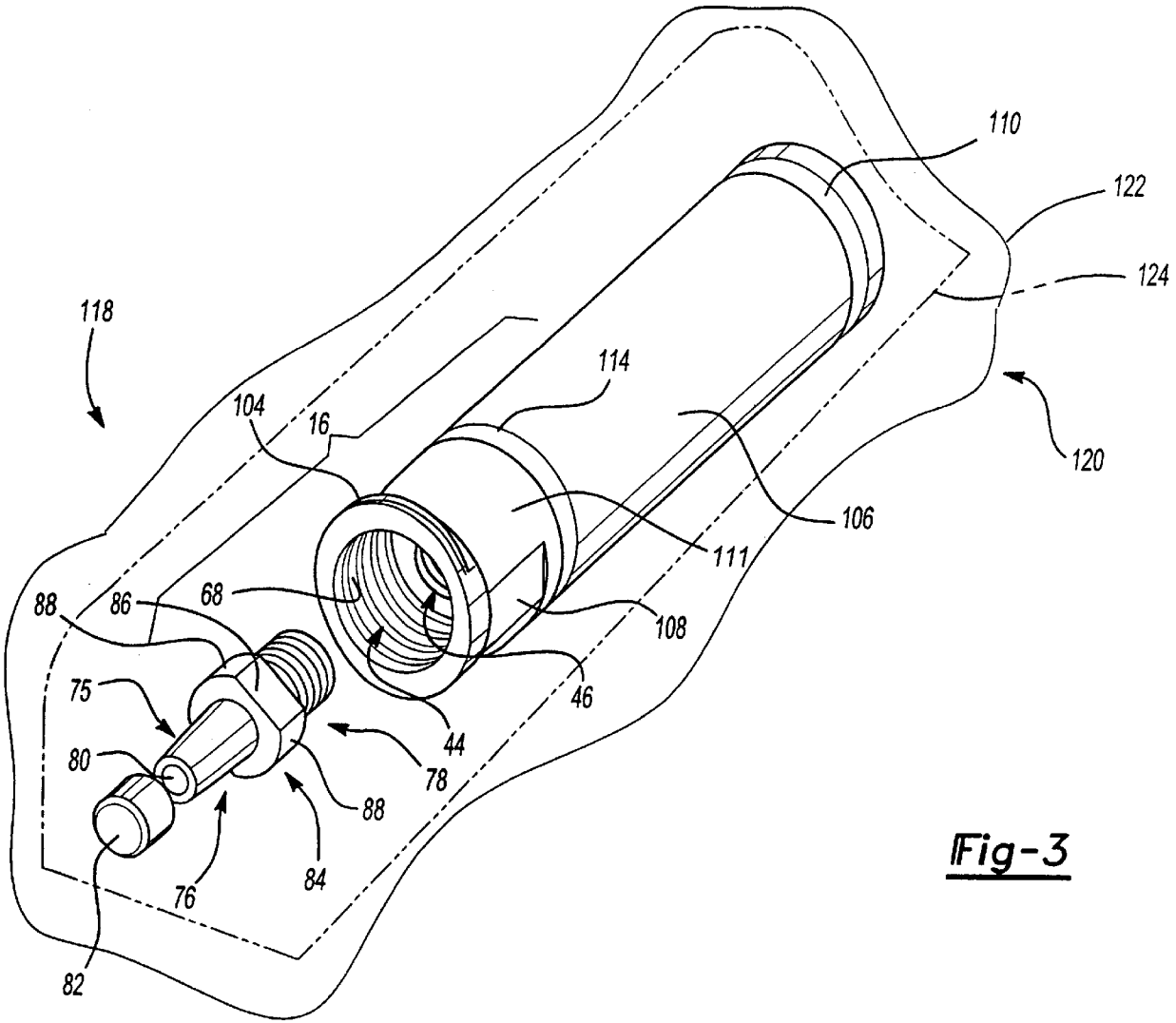
FIG. 3 is an assembly view of the plug assembly and a percussion nipple and percussion cap.

Referring to FIGS. 2 and 3, a percussion nipple 76 having a threaded male end 78 is threadably engaged with the threads 74 of the second inner surface 72. The percussion nipple 76 defines a central bore 80 to provide communication between a firing cap 82, hereinafter referred to as a percussion cap 82, and the black powder 56 in the powder chamber 42. The percussion cap 82 provides a spark necessary to ignite the black powder 56. The percussion cap 82 is slidably fit onto a cap end 75 of the percussion nipple 76. The percussion nipple 76 further includes a nipple flange 84 having diametrically opposed flat surfaces 86 interconnected by diametrically opposed arcuate surfaces 88. Several configurations of the percussion nipple 76 can be used. For example, FIG. 2 shows an alternative percussion nipple 76 having an additional nipple flange 84*a* with the percussion cap 82 slidably fit on the cap end 75 of the percussion nipple 76. The tool 70 engages the nipple flange 84 to thread and unthread the percussion nipple 76 from the threads 74 of the second inner surface 72, as will be described below. As will be appreciated by those skilled in the art, a primer cap and a converter for converting from a nipple-fired to a primer-cap fired plug assembly could be used as well. In this manner, the converter is threadably inserted into the ignition counterbore 46 and the converter receives the primer cap to be fired.

Figure 4:
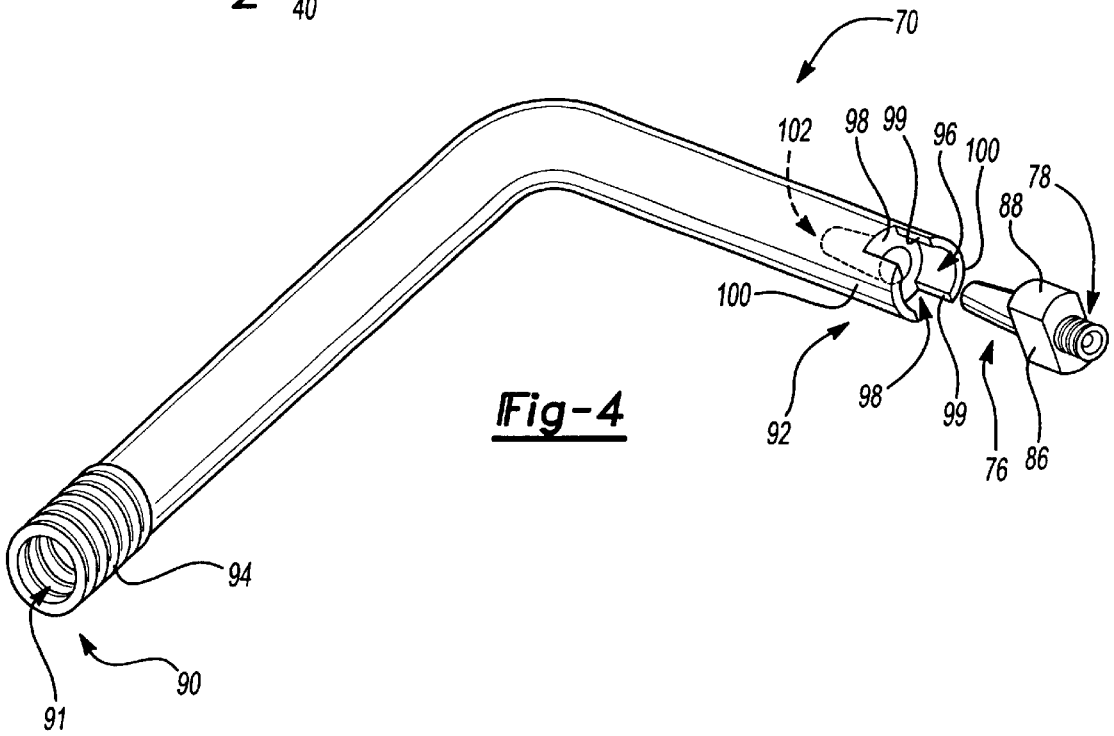
FIG. 4 is a perspective view of a tool used to remove the plug assembly from a breech of a breech-loaded firearm.

Referring to FIG. 4, the tool 70 of the preferred embodiment is generally L-shaped and made from cylindrical stock. The tool 70 is made from steel, but can be made from any number of materials including plastic, wood, aluminum, copper, and the like. The tool 70 includes a plug body end 90 and a percussion nipple end 92. Hence, the plug body end 90 is used to remove the plug body 36 from the breech 10 of the breech-loaded firearm 12, and the percussion nipple end 92 is used to thread and unthread the percussion nipple 76 with the plug body 36.

The plug body end 90 of the tool 70 includes threads 94 to threadably engage the threads 68 of the first inner surface 64 to remove the plug body 36 from the breech 10. Thus, the threads 94 of the plug body end 90 of the tool 70 are sized to be in mating engagement with the threads 68 of the first inner surface 64. The plug body end 90 also defines an opening 91 to receive the percussion nipple 76 when engaging the threads 94 of the plug body end 90 with the threads 68 of the first inner surface 64. The opening 91 allows the percussion nipple 76 to remain in the ignition counterbore 46 while the tool 70 is used to remove the plug body 36 from the breech 10.

The percussion nipple end 92 includes a first recess 96 and a pair of diametrically opposed slots 98 inter-positioned by a pair of fingers 100 to engage the nipple flange 84 of the percussion nipple 76. The flat surfaces 86 of the nipple flange 84 are engaged by edges 99 of the fingers 100 to thread and unthread the percussion nipple 76 from the ignition counterbore 46 while the arcuate surfaces 88 of the percussion nipple 76 extend through the diametrically opposed slots 98. A second recess 102 generally in the shape of the cap end 75 of the percussion nipple 76 receives the cap end 75 of the percussion nipple 76 when the nipple flange 84 is engaged.

The plug body 36 includes a partial flange 104 partially surrounding the second end 40 of the plug body 36 to limit movement of the plug body 36 in the breech 10. The partial flange 104 extends radially from the central axis 48 and from the second opening 60 at the second end 40 of the plug body 36. The partial flange 104 engages the breech end 20 of the barrel 18 to prevent the plug body 36 from sliding through the barrel 18 toward the sight end. The purpose of the partial flange 104 is to engage the breech end 20 of the barrel 18 and to bypass an ejector mechanism (not shown) of the breech-loaded firearm 12 to prevent the plug assembly 16 from being ejected from the breech-loaded firearm 12 when opened. Many conventional shotguns and other breech-loaded firearms include the ejector mechanism to eject shells having flanges from the breech. The ejector mechanism contacts the flange of the shells when the breech is opened to eject the shell. Therefore, it is necessary for the partial flange 104 of the plug body 36 to only partially surround the second end 40 to maintain a large enough gap or notch to bypass the ejector mechanism.

The plug body 36 includes an outer surface 106 having a pair of diametrically opposed surfaces 108 that are planar interconnected by a pair of diametrically opposed surfaces 111 that are curved, hereinafter referred to as planar surfaces 108 and curved surfaces 111. The planar surfaces 108 are engaged by a conventional end wrench (not shown) to restrict movement of the plug body 36. Restricted movement is important when the user is either removing or inserting the percussion nipple 76 into the ignition counterbore 46, or more importantly, when the user is disengaging the plug body end 90 of the tool 70 from the access counterbore 44. In use, the user engages the plug body 36 with the end wrench about the planar surfaces 108. The user then grasps the tool 70 and rotates the tool 70 counterclockwise to unthread the plug body end 90 from the threads 68 of the first inner surface 64 of the access counterbore 44. In the preferred embodiment, the planar surfaces 108 are adjacent to the second end 40 of the plug body 36, as shown in FIG. 1. FIG. 2 shows an alternative orientation of the planar surfaces relative to the flange 104 of the plug body 36, shown in FIG. 1.

A first seal ring 110 engages the plug body 36 to seal the plug body 36 in the breech 10 of the breech-loaded firearm 12. The outer surface 106 of the plug body 36 defines a first groove 112 to seat the first seal ring 110. A second seal ring 114 engages the plug body 36 to further seal the plug body 36 in the breech 10 of the breech-loaded firearm 12. The outer surface 106 of the plug body 36 defines a second groove 116 to seat the second seal ring 114. The first and second seal rings 110,114 are conventional O-rings made from an elastomeric material, but can be made from other materials. The first and second grooves 112,116 and the first and second seal rings 110,114 seated in the grooves 112,116 are annular about the plug body 36. The first and second seal rings 110,114 provide a snug fit of the plug body 36 in the breech 10. In addition, the first and second seal rings 110,114 provide a seal between the plug body 36 and the smooth inner surface 24 of the barrel 18. The seal is critical in preventing blow-back of ignition gases and fumes when firing the firearm. If the ignition gases and fumes escape past the first seal ring 110, they are trapped in an annular space 115 defined between the first and second seal rings 110,114 when the plug body 36 is in the breech 10. With the exception of the first and second grooves 112,116 and the diametrically opposed planar surfaces 108, the outer surface 106 of the plug body 36 is smooth and continuous from the first end 38 to the second end 40. This facilitates the engagement of the plug body 36 with the smooth inner surface 24 of the barrel 18 and provides a tight fit for the plug body 36 in the breech 10. In particular, reducing the size of the annular space 115 between the smooth inner surface 24 and the plug body 36 restricts the escape of ignition gases and fumes past the first seal ring 110.

A kit 118 can be carried or used by the user to convert the breech-loaded firearm 12 to the muzzle-loaded firearm 14. In the preferred embodiment, the kit 118 comprises packaging 120 in the form of plastic 122 with a cardboard backing 124. Other packaging such as vacuum-sealed plastic, cardboard with plastic straps, a plastic or cardboard box, and the like could also be used. The plug body 36 and the percussion nipple 76 as described above are disposed and secured in the packaging 120. The kit 118 further includes the first and second seal rings 110,114 disposed in the packaging 120.

The kit 118 can include the tool 70, a plurality of the projectiles 26, wadding 126 to wrap around the projectiles 26, the black powder 56 to charge the breech-loaded firearm 12, and a plurality of percussion caps 82 to ignite the black powder 56, as described above. All of which are disposed in the packaging 120. The kit 118 can further include a ramrod (not shown) to pack the projectiles 26 and wadding against the first end 38 of the plug body 36. It is to be appreciated that separate packaging can be used for these components of the kit 118, especially to isolate the black powder 56 and the percussion caps 82.

In operation, the plug assembly 16 is placed in the breech 10 of the breech-loaded firearm 12 while the breech 10 is in the open position (not shown). The percussion nipple 76 is threaded into the ignition counterbore 46 of the plug body 36 and the breech 10 is closed by the stock 28 to prepare for loading the black powder 56. The black powder 56 is placed in the powder chamber 42 of the plug body 36 via the sight end of the barrel 18, hence the conversion to a muzzle-loaded firearm 14. Once the black powder 56 is in place in the powder chamber 42, the projectile 26, typically in the form of a lead ball, sized for the barrel 18, is wrapped in the wadding 126 and rammed into place at the first end 38 of the plug body 36. The ramrod rams the wadding 126 and projectile 26 into the barrel 18 as shown by the arrow 128 in FIG. 2. The breech 10 is re-opened by moving the stock 28 and the percussion cap 82 is placed on the percussion nipple 76 as previously described. The breech-loaded firearm 12 is ready for firing via the triggering mechanism 30 and the firing pin 32. As the triggering mechanism 30 is placed in a firing position (not shown), the firing pin 32 thrusts forward against the bias of the spring 34 and contacts the percussion cap 82 to create a flash that ignites the powder charge 56 and propels the projectile 26 out of the sight end of the breech-loaded firearm 12.

After firing, the user may remove the plug assembly 16 from the breech 10 of the breech-loaded firearm 12 using the tool 70 shown in FIG. 4. The user engages the plug body 36 with the tool 70. This is accomplished by threading the plug body end 90 of the tool 70 with the threads 68 of the access counterbore 44 while rotating the tool 70 clockwise. Once the tool 70 and the plug body 36 are engaged, or more specifically, interlocked, the user pulls the tool 70 thereby applying an axially generated force to the threads 68 in the access counterbore 44 to slide the plug assembly 16 from the breech 10.

Obviously, many modifications and variations of the present invention are possible in light of the above teachings. The invention may be practiced otherwise than as specifically described within the scope of the appended claims, wherein that which is prior art is antecedent to the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the incentive novelty exercises its utility.

What is claimed is:

1. A plug assembly for inserting in a breech of a breech-loaded firearm to convert the breech-loaded firearm to a muzzle-loaded firearm, said assembly comprising:

a plug body having a first end and a second end, said plug body defining a powder chamber adjacent said first end, an ignition counterbore in firing communication with said powder chamber, and an access counterbore adjacent said second end of said plug body;

said assembly characterized by said plug body having a mechanical interlocking device in said access counterbore for receiving an axially generated force to facilitate removal of said plug body from the breech by sliding said plug body from the breech using the axially generated force.

2. The plug assembly as set forth in claim 1 wherein said access counterbore is further defined by a first inner surface of said plug body.

3. The plug assembly as set forth in claim 2 wherein said mechanical interlocking device is further defined as said first inner surface having threads to facilitate removal of said plug body from the breech of the breech-loaded firearm.

4. The plug assembly as set forth in claim 3 wherein said ignition counterbore is further defined by a second inner surface of said plug body having threads, said threads of said second inner surface having a smaller diameter than said threads of said first inner surface.

5. The plug assembly as set forth in claim 4 including a percussion nipple having a threaded male end threadably inserted in said threads of said second inner surface.

6. The plug assembly as set forth in claim 1 wherein said plug body is generally cylindrical in shape and includes a pair of diametrically opposed surfaces that are planar interconnected by a pair of diametrically opposed surfaces that are curved.

7. The plug assembly as set forth in claim 1 wherein said plug body includes a partial flange partially surrounding said second end of said plug body to limit movement of said plug body in the breech.

8. The plug assembly as set forth in claim 1 including a first seal ring engaging said plug body for sealing said plug body in the breech of the breech-loaded firearm.

9. The plug assembly as set forth in claim 8 wherein said plug body includes an outer surface and said outer surface defines a first groove for seating said first seal ring.

10. The plug assembly as set forth in claim 9 including a second seal ring engaging said plug body for sealing said plug body in the breech of the breech-loaded firearm.

11. The plug assembly as set forth in claim 10 wherein said outer surface of said plug body defines a second groove for receiving said second seal ring.

12. The plug assembly as set forth in claim 1 wherein said first end of said plug body includes a rim, said rim being beveled to facilitate placement of a projectile adjacent said powder chamber.

13. A firearm for propelling a projectile, comprising:

a barrel defining a breech;

a plug body slidable in said breech having a first end and a second end, said plug body defining a powder chamber adjacent said first end, an ignition counterbore in firing communication with said powder chamber, and an access counterbore adjacent said second end of said plug body;

said firearm characterized by said plug body having a mechanical interlocking device in said access counterbore for receiving an axially generated force to facilitate removal of said plug body from said breech by sliding said plug body from said breech using the axially generated force.

14. The firearm as set forth in claim 13 wherein said access counterbore is further defined by a first inner surface of said plug body.

15. The firearm as set forth in claim 14 wherein said mechanical interlocking device is further defined as said first inner surface having threads to facilitate removal of said plug body from said breech of said barrel.

16. The firearm as set forth in claim 15 wherein said ignition counterbore is further defined by a second inner surface of said plug body having threads, said threads of said second inner surface having a smaller diameter than said threads of said first inner surface.

17. A plug assembly for inserting in a breech of a muzzle-loaded firearm, comprising:

a plug body having a first end, a second end, and a first inner surface, said plug body defining a powder chamber adjacent said first end, an ignition counterbore in firing communication with said powder chamber, and an access counterbore adjacent said second end of said plug body wherein said access counterbore is further defined by said first inner surface of said plug body;

said assembly characterized by said first inner surface having threads to facilitate removal of said plug body from the breech of the muzzle-loaded firearm.

18. A method of removing a plug assembly from a breech of a firearm wherein the plug assembly comprises a plug body having a first end, a second end, and a first inner surface and the plug body defines a powder chamber adjacent the first end, an ignition counterbore in firing communication with the powder chamber, and an access counterbore adjacent the second end of the plug body, the plug body having a mechanical interlocking device in the access counterbore, said method comprising the steps of:

interlocking the mechanical interlocking device with a tool; and pulling on the tool to slide the plug body from the breech after interlocking the mechanical interlocking device with the tool.

* * * * *